US008433225B2

(12) United States Patent
Michibata

(10) Patent No.: US 8,433,225 B2
(45) Date of Patent: Apr. 30, 2013

(54) BELT DRIVING DEVICE AND IMAGE FORMING APPARATUS

(75) Inventor: Takumi Michibata, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 254 days.

(21) Appl. No.: 12/967,452

(22) Filed: Dec. 14, 2010

(65) Prior Publication Data

US 2011/0150541 A1 Jun. 23, 2011

(30) Foreign Application Priority Data

Dec. 17, 2009 (JP) ..... 2009-286090

(51) Int. Cl.
*G03G 15/01* (2006.01)

(52) U.S. Cl.
USPC ..... 399/302

(58) Field of Classification Search ..... 399/302, 399/303, 308
See application file for complete search history.

(56) References Cited

U.S. PATENT DOCUMENTS

| | | | | |
|---|---|---|---|---|
| 5,017,969 | A * | 5/1991 | Mitomi et al. | 399/299 |
| 6,160,978 | A * | 12/2000 | Tsuruoka et al. | 399/165 |
| 6,192,210 | B1 | 2/2001 | Munenori et al. | |
| 6,733,407 | B2 * | 5/2004 | Wakana | 474/92 |
| 2006/0116230 | A1 * | 6/2006 | Satoh et al. | 474/166 |

FOREIGN PATENT DOCUMENTS

| | | | |
|---|---|---|---|
| JP | 63-100477 | | 5/1988 |
| JP | 04-098284 | | 3/1992 |
| JP | 10-104995 | A | 4/1998 |
| JP | 2000-155478 | A | 6/2000 |
| JP | 2002-182501 | A | 6/2002 |
| JP | 2002-326733 | A | 11/2002 |
| JP | 2007-298813 | A | 11/2007 |
| JP | 2008-76999 | A | 4/2008 |
| JP | 2008-090125 | | 4/2008 |

OTHER PUBLICATIONS

Office Action (Preliminary Notice of Rejection) dated Oct. 18, 2011, issued in the corresponding Japanese Patent Application No. 2009-286090, and an English Translation thereof.
Notice of Allowance issued in corresponding Japanses Patent Application No. 2009-286090, dated Aug. 21, 2012, and English translation thereof.

* cited by examiner

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

In an intermediate transfer belt unit, elastic bodies are provided on respective inner circumferences of side edge portions of an intermediate transfer belt along with the circumferential direction. Rotating members are attached to respective opposite ends of a follower roller rotatably and concentrically with the follower roller, so as to face respective elastic bodies of the intermediate transfer belt. Each of the rotating members is composed of a tapered section, a bottom receiving section to keep bending of the intermediate transfer belt within a certain amount, a small diameter section forming an escape groove for receiving the elastic body of the intermediate transfer belt, and a large diameter section.

5 Claims, 3 Drawing Sheets

BELT DRIVING DEVICE AND IMAGE FORMING APPARATUS

This application is based on an application No. 2009-286090 filed in Japan on Dec. 17, 2009, the entire content of which is hereby incorporated by reference.

TECHNICAL FIELD

The present invention relates to a belt driving device, more particularly to a belt driving device for driving intermediate transfer belts that are incorporated in image forming apparatuses such as copying machines and printers, and also relates to an image forming apparatus having the belt driving device.

BACKGROUND ART

One conventional belt driving device for use in image forming apparatuses includes a fixing belt stretched over a pair of rollers, the fixing belt having a pair of block bodies integrated with respective inner circumferences of a pair of side edge portions of the fixing belt along a circumferential direction thereof. An axial end portion of the roller is made into a tapered surface. When the fixing belt is likely to lean to either side of the axial direction of the roller, the block body of the fixing belt comes into contact with an end portion forming the tapered surface of the roller, by which leaning of the fixing belt is regulated (FIG. 4B in JP 2002-182501A).

SUMMARY OF INVENTION

Technical Problem

However, in the conventional belt driving device, the fixing belt is stretched over a pair of the rollers with tension, and therefore, of the fixing belt, a pair of the side edge portions which are positioned at respective outsides of the rollers with respect to axial direction thereof is likely to bend toward the inner surface of the fixing belt due to the tension. Particularly, when the fixing belt is likely to lean to either side of the axial direction of the roller, one of the side edge portions, which is on the side separating from an end face of the fixing roller, gains a larger bending. Since thinner belts are being developed in recent years in particular, generation of a larger bending is increasing. This causes generation of a crack on the fixing belt with the bent portion as a starting point, resulting in a reduced life span of the fixing belt.

Accordingly, an object of the present invention is to provide a belt driving device capable of preventing generation of a crack on the endless belt with the bent portion as a starting point and thereby providing a longer life span for the endless belt.

Another object of the present invention is to provide an image forming apparatus having such a belt driving device.

Solution to Problem

In order to achieve the above object, a belt driving device according to the present invention is a belt driving device for use in an image forming apparatus, comprising:

a plurality of rollers placed in parallel with each other;

an endless belt wound with tension so as to encircle all of a plurality of rollers, the endless belt having a pair of side edge portions that should be positioned at respective outsides of a plurality of the rollers with respect to axial direction of the rollers, with first and second elastic bodies provided on respective inner circumferences of a pair of the side edge portions along a circumferential direction of the belt; and first and second rotating members attached to respective opposite ends of at least one roller out of a plurality of the rollers, so as to face the first and second elastic bodies, respectively, and to be concentric with the one roller, wherein the first and second rotating members respectively have:

first and second tapered sections each having a tapered form with a width decreasing from inside toward outside with respect to the axial direction and coming into contact with the first and second elastic bodies provided on the endless belt, respectively, so as to regulate meandering of the endless belt; and first and second bottom receiving sections provided at respective outsides of the first and second tapered sections with respect to the axial direction and having a shape thicker than respective outer ends of the first and second tapered sections, so as to keep bending of the endless belt within a certain amount.

An image forming apparatus according to the present invention comprises such a belt driving device as described above.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Hereinbelow, the invention will be described in detail in conjunction with the embodiments with reference to the drawings.

Figure 1:
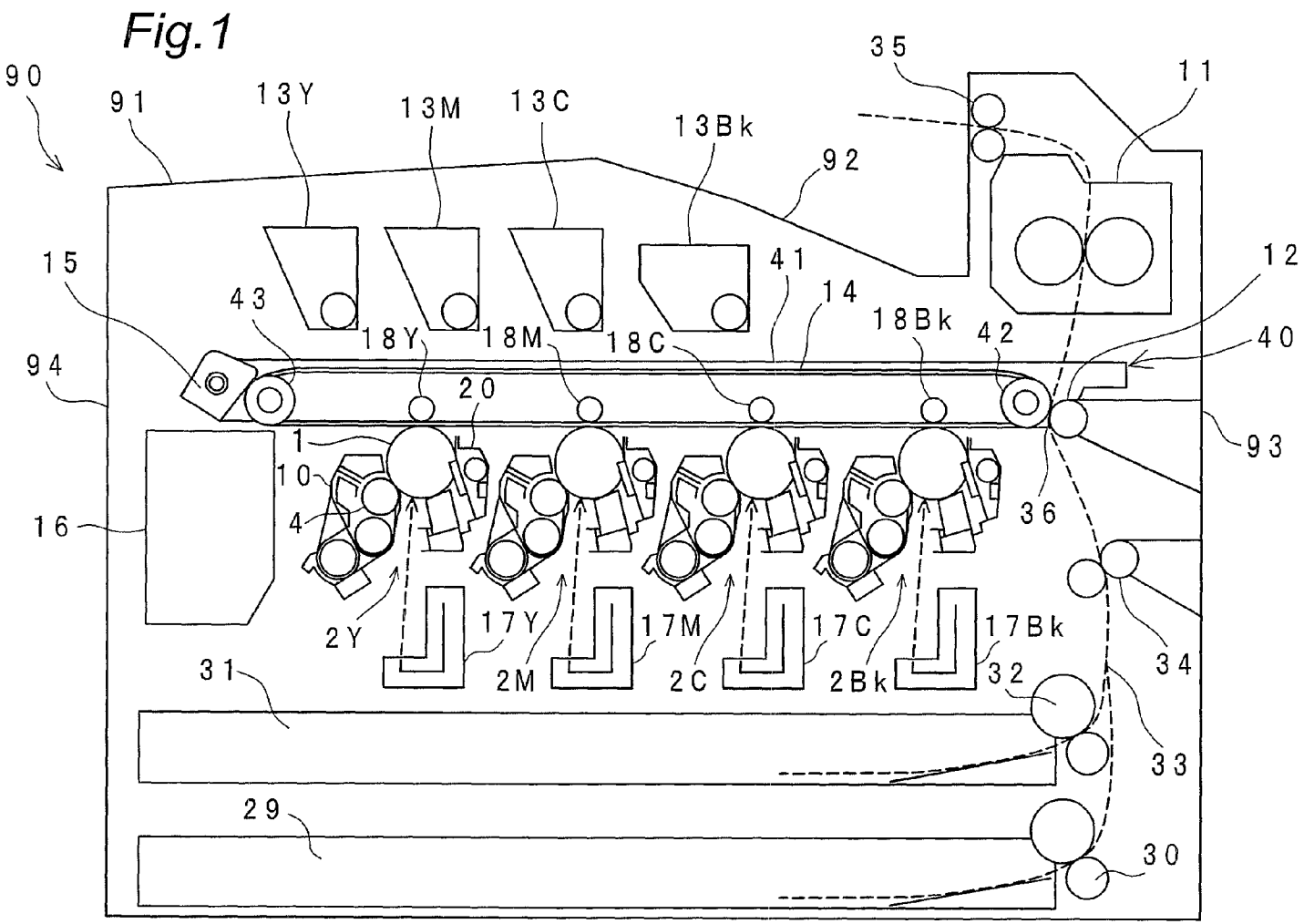
FIG. 1 is a view showing a cross sectional configuration of an image forming apparatus having a belt driving device in one embodiment of the invention.

FIG. 1 shows a cross sectional configuration of a color tandem-type image forming apparatus 90 in one embodiment of the invention. The image forming apparatus 90 includes a main body casing 91 as a main body and an intermediate transfer belt unit 40 detachably attached to the main body casing 91 at an approximate center inside the main body casing 91.

The intermediate transfer belt unit 40 as a belt driving device shown in FIG. 1 has a pair of frames 41, 41 (only one frame 41 is shown in FIG. 1) extending horizontally inside the main body casing 91 and also extending in a direction substantially perpendicular to a right side surface 93 and a left side surface 94, a driving roller 42 and a follower roller 43 each pivotally supported by corresponding end portions of a pair of the frames 41, 41, and an intermediate transfer belt 14 wound with tension so as to encircle the driving roller 42 and the follower roller 43. Tension is given to the intermediate transfer belt 14 by the driving roller 42 and the follower roller 43, and the intermediate transfer belt 14 is made to rotate counterclockwise in FIG. 1. Inside the intermediate transfer belt 14, primary transfer rollers 18Bk, 18C, 18M and 18Y are provided at specific intervals along the longitudinal direction of the frame 41. These primary transfer rollers 18Bk, 18C, 18M and 18Y are pivotally supported (i.e., the shafts of the rollers are rotatably supported) by a pair of the frames 41, 41, respectively. Further, a belt cleaner 15 is attached to between left end parts of a pair of the frames 41, 41. On the right side surface 93 of the main body casing 91, a secondary transfer roller 12 as a pressure roller is attached so as to protrude inward in the casing. The secondary transfer roller 12 is biased toward the driving roller 42 by an unshown spring and is brought into pressure contact with the intermediate transfer belt 14 to form a nip section (toner transfer position) 36.

Provided above the intermediate transfer belt unit 40 are, from the right-hand side, toner cartridges 13Bk, 13C, 13M and 13Y containing supplemental toner of Bk (black), C (cyan), M (magenta), and Y (yellow), respectively.

Provided below the intermediate transfer belt unit 40 are, also from the right-hand side, imaging cartridges 2Bk, 2C, 2M and 2Y as process cartridges of Bk C, M, and Y, respectively. The respective imaging cartridges 2Bk, 2C, 2M and 2Y have completely the same structure except for the difference in toner color that they handle. More specifically, the yellow imaging cartridge 2Y for example is integrally composed of a developing device 10 for performing development with use of a two-component developer containing a toner and a carrier, and a photoconductor drum unit 20 including a photoconductor drum 1, a charging device and a cleaner for cleaning transfer residual toner on the photoconductor drum surface. The photoconductor drums 1 of the respective imaging cartridges 2Bk, 2C, 2M and 2Y are placed in positions corresponding to the primary transfer rollers 18Bk, 18C, 18M and 18Y of the intermediate transfer belt unit 40 across the intermediate transfer belt 14. Below each of the imaging cartridges 2Bk, 2C, 2M and 2Y, exposure devices 17Bk 17C, 17M and 17Y are provided for exposing the photoconductor drum surfaces of the corresponding imaging cartridges to form latent images thereon.

Two rows of paper cassettes 29, 31 for housing unshown paper sheets are provided in the lower part of the inside of the main body casing 91. Inside the main body casing 91, a conveying path (shown by a dashed line) 33 is provided for conveying paper sheets as sheets along the right side surface 93. Paper sheets are sent out from the paper cassette 29 or 31 to the conveying path 33 by a feed roller 30 or 32, and are further conveyed upward by a conveying roller 34 as a sheet conveying section mounted on the right side surface 93.

A fixing unit 11 for fixing toner onto paper sheets is provided in an upper right portion in the main body casing 91.

A waste toner box 16 for collecting and storing residual toner removed from the surface of the intermediate transfer belt 14 by the belt cleaner 15 is provided in a position corresponding to a lower side of the belt cleaner 15 provided in a left end part of the intermediate transfer belt unit 40 inside the main body casing 91.

At the time of image formation, a paper sheet sent out from the paper cassette 29 or 31 to the conveying path 33 is fed into the toner transfer position 36 between the intermediate transfer belt 14 and the secondary transfer roller 12 by the conveying roller 34. In the respective imaging cartridges 2Bk, 2C, 2M and 2Y, the surfaces of the photoconductor drums 1 are uniformly charged by a charging device, and are further exposed by the exposure devices 17Bk, 17C, 17M and 17Y to form latent images thereon. Next, a predetermined developing bias is applied to a developing roller 4 as a developer carrier included in the developing device 10, by which the toner contained in a developer flies and latent images are visualized (developed) thereby. As a result, a toner image is formed on the surface of each of the photoconductor drums 1. Toner images formed on the respective photoconductor drums 1 are transferred in sequence onto the intermediate transfer belt 14 by the primary transfer rollers 18Bk, 18C, 18M and 18Y of the intermediate transfer belt unit 40, and are further transferred onto a paper sheet sent into the aforementioned toner transfer position 36 by the secondary transfer roller 12. The paper sheet with toner images transferred thereon is conveyed through the fixing unit 11, so that toner images are fixed onto the paper sheet. The paper sheet with the toner images fixed thereto is then discharged by a paper ejecting roller 35 into a paper ejection tray section 92 provided on the upper surface of the main body casing 91.

Figure 2:
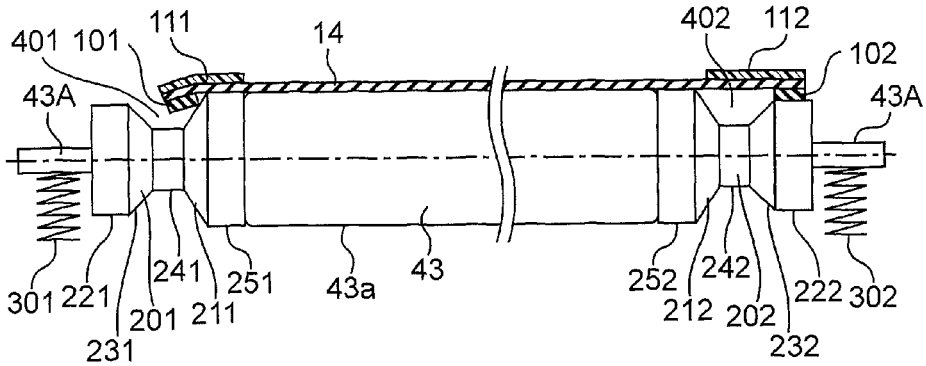
FIG. 2 is a view for explaining a configuration of a principal part of the belt driving device.
Figure 3:
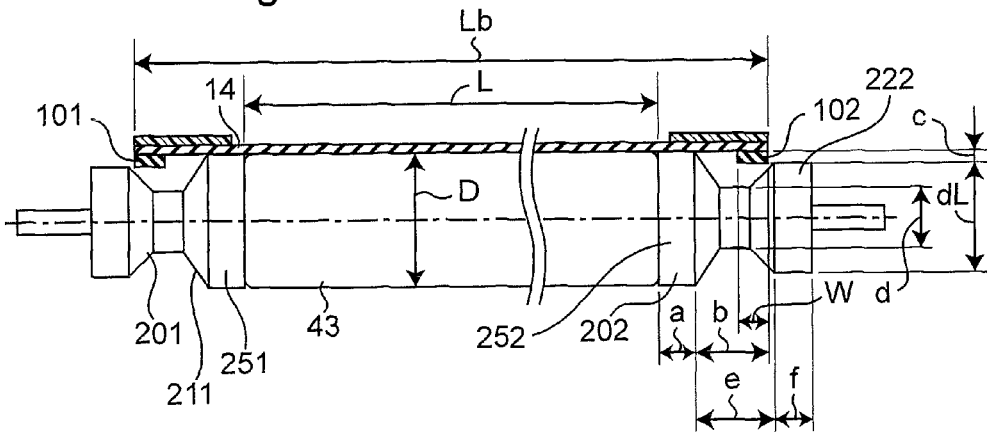
FIG. 3 is a view for explaining position and size of a principal part of the belt driving device.

Detailed description is now given of the intermediate transfer belt 14 and the follower roller 43, which are the primary part of the intermediate transfer belt unit 40. FIG. 2 shows a concrete configuration example of the intermediate transfer belt 14 and the follower roller 43. FIG. 3 is a view for explaining position and size of the intermediate transfer belt 14 and the follower roller 43. FIG. 2 and FIG. 3 are a cross sectional view of the intermediate transfer belt 14 and a plan view of the follower roller 43 seen along the width direction of the intermediate transfer belt 14.

As shown in FIG. 2, the intermediate transfer belt 14 has a first elastic body 101 and a second elastic body 102 attached to the inner circumference of a pair of side edge portions, which should be positioned at respective outsides of the follower roller 43 with respect to an axial direction thereof, along the circumferential direction of the belt 14. A first reinforcing tape 111 and a second reinforcing tape 112 are also attached to the outer circumference of a pair of the side edge portions along the circumferential direction of the belt 14. The intermediate transfer belt 14 is wound around the follower roller 43 with tension by tension springs 301, 302 that are in pressure contact with a driven roller shaft 43A. Accordingly, of the intermediate transfer belt 14, a pair of the side edge portions which are positioned at respective outsides of the follower roller 43 with respect to the axial direction is likely to bend toward an inner surface of the intermediate transfer belt 14 due to the tension.

The follower roller 43 is supported by the main body casing 91 via an unshown frame. The first rotating member 201 is attached to one end of the follower roller 43 rotatably and concentrically with the follower roller 43 so as to face the first elastic body 101 of the intermediate transfer belt 14. Similarly, the second rotating member 202 is attached to the other end of the follower roller 43 rotatably and concentrically with the follower roller 43 so as to face the second elastic body 102 of the intermediate transfer belt.

As shown in FIG. 3, the intermediate transfer belt 14 has a width Lb of 350 mm in this example. The first elastic body 101 and the second elastic body 102 of the intermediate transfer belt 14 have a width W of 3 mm and a thickness c of 4 mm and should preferably be made of a material such as silicone rubber and fluororubber with elasticity and high heat resistance.

The follower roller 43 has an axial length L of 333 mm and an outer diameter D of 45 mm (outer radius R of 22.5 mm).

The first rotating member 201 shown in FIG. 2 is composed of a first tapered section 211, a first bottom receiving section 221, a third tapered section 231, a first small diameter section 241 and a first large diameter section 251. The first rotating member 201 is made of POM (polyoxymethylene).

The first tapered section 211 has a tapered form with a width decreasing from inside toward outside of the follower roller 43 with respect to the axial direction. The first bottom receiving section 221 is provided outside the first tapered section 211 with respect to the axial direction and has a cylindrical surface with a diameter larger than that of outer end of the first tapered section 211. An outer radius r of the cylindrical surface is 18.2 mm (outer diameter dL shown in FIG. 3 is 36.4 mm). The axial length of the cylindrical surface is 3.5 mm.

The first small diameter section 241 forms a first escape groove 401 between the first tapered section 211 and the first bottom receiving section 221 for receiving the first elastic body 101. The third tapered section 231 is provided between the first small diameter section 241 and the first bottom receiving section 221 to have a tapered form with a width increasing from inside toward outside with respect to the axial direction. The first large diameter section 251 is provided inside the first tapered section 211 with respect to the axial direction, circumscribed with the follower roller 43, and has a cylindrical surface with an outer radius (22.5 mm) identical to that of the follower roller 43.

As with the first rotating member 201, the second rotating member 202 is composed of a second tapered section 212, a second bottom receiving section 222, a fourth tapered section 232, a second small diameter section 242 and a second large diameter section 252. The second rotating member 202 is made of POM.

The second tapered section 212 has a tapered form with a width decreasing from inside toward outside of the follower roller 43 with respect to the axial direction. The second bottom receiving section 222 is provided outside the second tapered section 212 with respect to the axial direction and has a cylindrical surface with a diameter larger than that of outer end of the second tapered section 212. An outer radius r of the cylindrical surface is 18.2 mm (outer diameter dL shown in FIG. 3 is 36.4 mm).

The second small diameter section 242 forms a second escape groove 402 between the second tapered section 212 and the second bottom receiving section 222 for receiving the second elastic body 102. The fourth tapered section 232 is provided between the second small diameter section 242 and the second bottom receiving section 222 to have a tapered form with a width increasing from inside toward outside with respect to the axial direction. The second large diameter section 252 is provided inside the second tapered section 212 with respect to the axial direction, circumscribed with the follower roller 43, and has a cylindrical surface with an outer radius (22.5 mm) identical to that of the follower roller 43.

As shown in FIG. 3, when a length b from outer end of the second large diameter section 252 to outer end of the second elastic body 102 with respect to the axial direction is 6 mm for example, the axial length a [mm] of the second large diameter section 252 is defined by the following Equation 1:

$$Lb-2W=L+2a+b \quad \text{(Equation 1)}$$

wherein Lb=350, L=333, W=3, and b=6 so that the axial length a of the second large diameter section 252 is 2.5 mm. A length e from outer end of the second large diameter section 252 to inner end of the second bottom receiving section 222 with respect to the axial direction is 6.5 mm. Further, the axial length f of the cylindrical surface of the second bottom receiving section 222 is 3.5 mm as mentioned above. According to the relation equivalent to the length b and W in the first elastic body 101 and the first large diameter section 251, the intermediate transfer belt 14 meanders rightward for maximum 3 mm. In this regard, based on the relation between the lengths b and e, the moment the intermediate transfer belt 14 meanders rightward for at least 0.5 mm, the second elastic body 102 faces the second bottom receiving section 222 and is supported thereby. Further, based on the length f, even when the intermediate transfer belt 14 meanders rightward for 3 mm, the second elastic body 102 faces the second bottom receiving section 222 and is supported thereby. Accordingly, in the state that the first elastic body 101 is in contact with the first tapered section 211 after the intermediate transfer belt 14 has meandered rightward, the second elastic body 102 faces the second bottom receiving section 222 and is supported thereby.

A diameter d [mm] of the second small diameter section 242 in FIG. 3 is defined by the following Equation 2:

$$(dL-d)/2=2 \quad \text{(Equation 2)}$$

wherein dL=36.4 so that the diameter d [mm] of the second small diameter section 242 is 32.4 mm.

Figure 4:
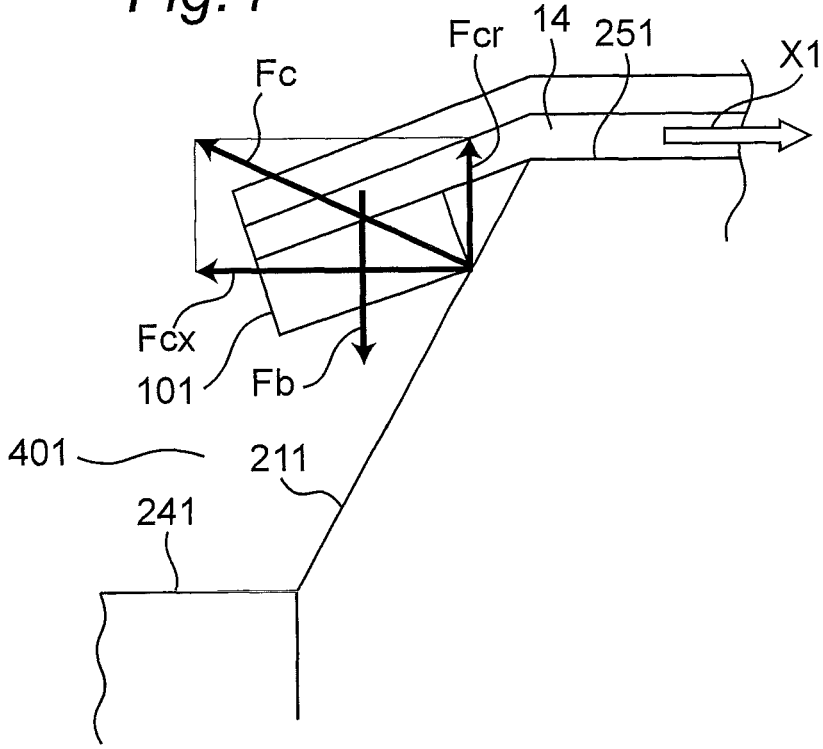
FIG. 4 is a view for explaining balance of the force in the principal part of the belt driving device at the time of regulating meandering of an endless belt.

In the present embodiment, when the intermediate transfer belt 14 is likely to lean to a first meandering direction X1 as shown in FIG. 4, the first elastic body 101 of the intermediate transfer belt 14 comes into contact with the first tapered section 211 and receives reaction force Fc from the first tapered section 211. An axial outward component Fcx of the reaction force Fc regulates the leaning to the first meandering direction X1. Similarly, when the intermediate transfer belt 14 is likely to lean to a second meandering direction opposite to the first meandering direction X1, the second elastic body 102 of the intermediate transfer belt 14 comes into contact with the second tapered section 212 and receives reaction force from the second tapered section 212. An axial outward component of the reaction force regulates the leaning to the second meandering direction. Therefore, meandering of the intermediate transfer belt 14 is regulated.

In this embodiment, as shown in FIG. 4, the first small diameter section 241 forms a first escape groove 401 for receiving the first elastic body 101 of the intermediate transfer belt 14. Accordingly, when the intermediate transfer belt 14 is likely to lean to the first meandering direction X1, the first elastic body 101 of the intermediate transfer belt 14 does not come into contact with the first small diameter section 241 but comes into contact with only the first tapered section 211. Therefore, a radial outward component Fcr of the force Fc that the first elastic body 101 of the intermediate transfer belt 14 receives from the first tapered section becomes smaller than the force Fb of the intermediate transfer belt 14 to bend toward the inner surface of the side edge portion. As a result, it becomes possible to prevent the first elastic body 101 of the intermediate transfer belt 14 from running upon a peripheral surface 43*a* of the follower roller 43. In a similar manner, the second small diameter section 242 forms a second escape groove 402 for receiving the second elastic body 102 of the intermediate transfer belt 14. Accordingly, when the intermediate transfer belt 14 is likely to lean to the second meandering direction, the second elastic body 102 of the intermediate transfer belt 14 does not come into contact with the second small diameter section 242 but comes into contact with only the second tapered section 212. A radial outward component of the force that the second elastic body 102 of the intermediate transfer belt 14 receives from the second rotating member becomes smaller than the force of the side edge portion of the intermediate transfer belt 14 to bend toward the inner surface, and therefore it becomes possible to prevent the second elastic body 102 of the intermediate transfer belt 14 from running upon the peripheral surface 43*a* of the follower roller 43. As a result, meandering of the intermediate transfer belt 14 is regulated more efficiently.

As mentioned before, of the intermediate transfer belt 14, a pair of the side edge portions which are positioned at respective outsides of the follower roller 43 with respect to the axial direction is likely to bend toward the inner surface of the intermediate transfer belt 14 due to the tension. In this embodiment, as shown in FIG. 2, the first bottom receiving section 221 is provided outside the first tapered section 211 with respect to the axial direction. Accordingly, when the intermediate transfer belt 14 is likely to lean to the second meandering direction, the first bottom receiving section 221 supports the first elastic body 101 of the intermediate transfer belt 14 to keep the bending within a certain amount. Similarly, the second bottom receiving section 222 is provided outside the second tapered section 212. As a consequence, when the intermediate transfer belt 14 is likely to lean to the first meandering direction, the second bottom receiving section 222 supports the second elastic body 102 of the intermediate transfer belt 14 to keep the bending within a certain amount. Therefore, in the image forming apparatus 90 having the intermediate transfer belt unit 40, the bending generated in a pair of the side edge portions of the intermediate transfer belt 14 can be kept within a certain amount. As a result, it becomes possible to prevent generation of a crack on the intermediate transfer belt 14 with the bent portion as a starting point, resulting in longer life span of the intermediate transfer belt 14.

In this embodiment, the outer surfaces (cylindrical surfaces) of the first bottom receiving section 221 and the second bottom receiving section 222 are parallel to the axial direction of the follower roller 43. Accordingly, even when the intermediate transfer belt 14 slightly fluctuates in the axial direction in the state of being likely to lean to the first meandering direction and therefore being regulated by the first elastic body 101 and the first tapered section 211 of the intermediate transfer belt 14, the bending amount is kept generally in the same level. Similarly, even when the intermediate transfer belt 14 slightly fluctuates in the axial direction in the state of being likely to lean to the second meandering direction and regulated by the second elastic body 102 and the second tapered section 212 of the intermediate transfer belt 14, the bending amount is kept generally in the same level. Therefore, it becomes possible to maintain the bending amount of the intermediate transfer belt 14 stable.

In this embodiment, the third tapered section 231 has a tapered form with a width increasing from inside toward outside of the follower roller 43 with respect to the axial direction. Accordingly, when the first elastic body 101 comes into contact with the third tapered section 231, the first elastic body 101 is not engaged by the third tapered section 231 but is smoothly supported by the first bottom receiving section 221. Similarly, the fourth tapered section 232 has a tapered form with a width increasing from inside toward outside with respect to the axial direction. Accordingly, when the second elastic body 102 comes into contact with the fourth tapered section 232, the second elastic body 102 is not engaged by the fourth tapered section 232 but is smoothly supported by the second bottom receiving section 222. Therefore, it becomes possible to maintain the bending amount of the intermediate transfer belt 14 stable.

In this embodiment, an outer radius R [mm] of the follower roller 43, an outer radius r [mm] of the first bottom receiving section 221 and a thickness c [mm] of the first elastic body 101 satisfy the following Equation 3:

$$r<(R-c)\leqq(r+0.7) \quad \text{(Equation 3)}$$

Therefore, it becomes possible to keep the bending of the intermediate transfer belt 14 within a certain amount. In this example, the outer radius R of the follower roller 43 is 22.5 mm, the outer radius r of the first bottom receiving section 221 is 18.2 mm, and the thickness c of the first elastic body 101 and the second elastic body 102 of the intermediate transfer belt 14 is 4 mm.

Figure 5:
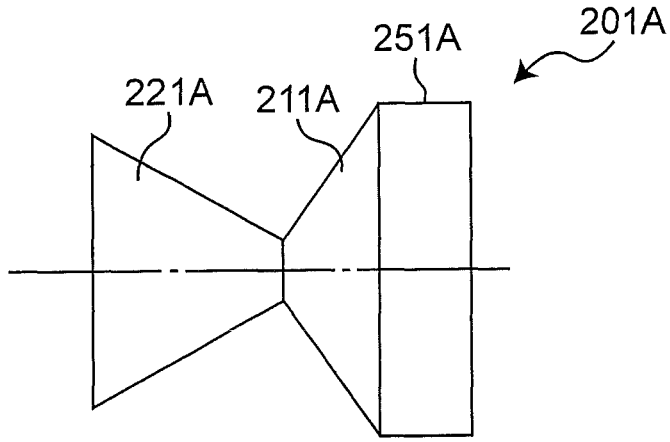
FIG. 5 is a plan view showing a modified example of a rotating member that constitutes a part of the belt driving device.

FIG. 5 is a plan view showing a first rotating member 201A as a modified example of the first rotating member 201. The first rotating member 201A is composed of a first tapered section 211A having a tapered form with a width decreasing from inside toward outside of the follower roller 43 with respect to the axial direction and coming into contact with the first elastic body 101 of the intermediate transfer belt 14 to regulate meandering of the intermediate transfer belt 14, a first bottom receiving section 221A provided outside the first tapered section 211A with respect to the axial direction and having a shape thicker than outer end of the first tapered section 211A to keep bending of the intermediate transfer belt 14 within a certain amount, and a first large diameter section 251A provided inside the first tapered section 211A with respect to the axial direction, circumscribed with the follower roller 43, and having a cylindrical surface with an outer radius (22.5 mm) identical to that of the follower roller 43. Unlike the first rotating member 201, the first rotating member 201A does not have a third tapered section 231 and a first small diameter section 241. Because of this reason, it is easier to machine the first rotating member 201A than the first rotating member 201. Therefore, manufacturing costs can be lowered. It is to be noted that the same modification is also applicable to the second rotating member 202.

Although the first rotating member 201 and the second rotating member 202 are made of POM in this embodiment, they are not limited thereto but may be members made of metal such as SUS (stainless steel), iron and aluminum, or made of other materials such as resin having heat resistance.

Although the first rotating member 201 and the second rotating member 202 are rotatably attached to the follower roller 43 in this embodiment, they may be fixed to the follower roller 43 so as to rotate together with the follower roller 43.

Although the intermediate transfer belt 14 was described as an example of an endless belt in this embodiment, the invention is not limited thereto and is naturally applicable to other belts such as transfer conveying belts and photoconductor belts.

The image forming apparatus may be any apparatus including monochrome/collar copying machines, printers, facsimiles, and multi-functional machines having these functions.

What has been disclosed herein is considered in all respects as illustrative, and therefore the configuration and materials of the invention are not limited thereto. They may appropriately be changed depending on apparatuses to use.

As described above, a belt driving device according to the present invention is a belt driving device for use in an image forming apparatus, comprising:

a plurality of rollers placed in parallel with each other;

an endless belt wound with tension so as to encircle all of a plurality of rollers, the endless belt having a pair of side edge portions that should be positioned at respective outsides of a plurality of the rollers with respect to axial direction of the rollers, with first and second elastic bodies provided on respective inner circumferences of a pair of the side edge portions along a circumferential direction of the belt; and first and second rotating members attached to respective opposite ends of at least one roller out of a plurality of the rollers, so as to face the first and second elastic bodies, respectively, and to be concentric with the one roller, wherein the first and second rotating members respectively have:

first and second tapered sections each having a tapered form with a width decreasing from inside toward outside with respect to the axial direction and coming into contact with the first and second elastic bodies provided on the endless belt, respectively, so as to regulate meandering of the endless belt; and first and second bottom receiving sections provided at respective outsides of the first and second tapered sections with respect to the axial direction and having a shape thicker than respective outer ends of the first and second tapered sections, so as to keep bending of the endless belt within a certain amount.

In the belt driving apparatus of the invention, when the endless belt is likely to lean to one direction with respect to the axial direction of the roller, e.g., from the side of the first rotating member toward the side of the second rotating member (referred to as "first meandering direction"), the first elastic body of the endless belt comes into contact with the first tapered section so that the leaning to the first meandering direction is regulated. As a result, the endless belt can no longer lean to the first meandering direction. Similarly, when the endless belt is likely to lean to the direction opposite to the first meandering direction (referred to as "second meandering direction"), the second elastic body of the endless belt comes into contact with the second tapered section, so that the leaning to the second meandering direction is regulated. Consequently, the endless belt can no longer lean to the second meandering direction. As a result of these functions, meandering of the endless belt is regulated.

In this belt driving apparatus, the endless belt is wound with tension so as to encircle all of a plurality of the rollers. Accordingly, of the endless belt, a pair of the side edge portions which are positioned at respective outsides of the roller with respect to the axial direction is likely to bend toward an inner surface of the endless belt due to the tension. In this regard, the first bottom receiving section is provided outside the first tapered section of the first rotating member with respect to the axial direction. Accordingly, when the endless belt is likely to lean to the second meandering direction, the first bottom receiving section supports the first elastic body of the endless belt to keep the bending within a certain amount. Similarly, the second bottom receiving section is provided outside the second tapered section of the second rotating member with respect to the axial direction. As a consequence, when the endless belt is likely to lean to the first meandering direction, the second bottom receiving section supports the second elastic body of the endless belt to keep the bending within a certain amount. Therefore, according to the belt driving device, the bending generated in a pair of the side edge portions of the endless belt can be kept within a certain amount. As a result, it becomes possible to prevent generation of a crack on the endless belt with the bent portion as a starting point, resulting in longer life span of the endless belt.

In the belt driving device of one embodiment, the first and second bottom receiving sections have a cylindrical surface with a diameter larger than that of the respective outer ends of the first and second tapered sections.

In the belt driving device, the first and second bottom receiving sections have a cylindrical surface with a diameter larger than that of respective outer ends of the first and second tapered sections. In short, the outer surfaces (cylinder surfaces) of the first and second bottom receiving sections are parallel to the axial direction of the roller. Accordingly, even when the endless belt slightly fluctuates in the axial direction in the state of being likely to lean to the first meandering direction and regulated by the first elastic body and the first tapered section of the endless belt, the bending amount is kept generally in the same level. Similarly, even when the endless belt slightly fluctuates in the axial direction in the state of being likely to lean to the second meandering direction and regulated by the second elastic body and the second tapered section of the endless belt, the bending amount is kept generally in the same level. Therefore, it becomes possible to maintain the bending amount of the endless belt stable.

In the belt driving device of one embodiment, the first rotating member includes: a first small diameter section to form a first escape groove between the first tapered section and the first bottom receiving section for receiving the first elastic body; and a third tapered section having a tapered form with a width increasing from inside toward outside with respect to the axial direction and provided between the first small diameter section and the first bottom receiving section, wherein the second rotating member includes: a second small diameter section to form a second escape groove between the second tapered section and the second bottom receiving section for receiving the second elastic body; and a fourth tapered section having a tapered form with a width increasing from inside toward outside with respect to the axial direction and provided between the second small diameter section and the second bottom receiving section.

In the belt driving device, the first small diameter section of the first rotating member forms a first escape groove between the first tapered section and the first bottom receiving section for receiving the first elastic body of the endless belt. Accordingly, when the endless belt is likely to lean to the first meandering direction, the first elastic body of the endless belt does not come into contact with the first small diameter section but comes into contact with only the first tapered section. Therefore, a radial outward component of the force that the first elastic body of the endless belt receives from the first rotating member becomes smaller than the force of the side edge portion of the endless belt to bend toward the inner surface, and therefore it becomes possible to prevent the first elastic body of the endless belt from running upon the peripheral surface of the roller. Similarly, the second small diameter section of the second rotating member forms a second escape groove between the second tapered section and the second bottom receiving section for receiving the second elastic body of the endless belt. Accordingly, when the endless belt is likely to lean to the second meandering direction, the second elastic body of the endless belt does not come into contact with the second small diameter section but comes into contact with only the second tapered section. Therefore, a radial outward component of the force that the second elastic body of the endless belt receives from the second rotating member becomes smaller than the force of the side edge portion of the endless belt to bend toward the inner surface, and therefore it becomes possible to prevent the second elastic body of the endless belt from running upon the peripheral surface of the roller. As a result of these functions, meandering of the endless belt may be regulated more efficiently.

In this belt driving device, the third tapered section has a tapered form with a width increasing from inside toward outside with respect to the axial direction and provided between the first small diameter section and the first bottom receiving section. Accordingly, when the endless belt is likely to lean to the second meandering direction, the first elastic body of the endless belt goes over the third tapered section with ease and is smoothly supported by the first bottom receiving section. The fourth tapered section has a tapered form with a width increasing from inside toward outside with respect to the axial direction and provided between the second small diameter section and the second bottom receiving section. Accordingly, when the endless belt is likely to lean to the first meandering direction, the second elastic body of the endless belt goes over the fourth tapered section with ease and is smoothly supported by the second bottom receiving section. Therefore, it becomes possible to maintain the bending amount of the endless belt stable.

In the belt driving device of one embodiment, an outer radius R [mm] of the at least one roller, an outer radius r [mm] of the first and second bottom receiving sections, and a thickness c [mm] of the first and second elastic bodies satisfy an equation below:

$$r<(R-c)\leqq(r+0.7).$$

In this belt driving device, an outer radius R [mm] of the at least one roller, an outer radius r [mm] of the bottom receiving section and a thickness c [mm] of the first and second elastic bodies satisfy an equation: $r<(R-c)\leqq(r+0.7)$. Therefore, it becomes possible to keep the bending of the endless belt within a certain amount.

In the belt driving device of one embodiment, the endless belt is used for image transfer.

The endless belt is used for image transfer in the belt driving device. Therefore, it becomes possible to keep the bending of the endless belt used for image transfer within a certain amount.

An image forming apparatus according to the present invention comprises such a belt driving device as described above.

According to the image forming apparatus of the present invention, the bending generated in a pair of the side edge portions of the endless belt can be kept within a certain amount. As a result, it becomes possible to prevent generation of a crack on the endless belt with the bent portion as a starting point, resulting in longer life span of the endless belt.

As described above, according to the belt driving device of the invention, it becomes possible to prevent generation of a crack on the endless belt with the bent portion as a starting point, resulting in longer life span of the endless belt.

Since the image forming apparatus of the invention has the belt driving device, it becomes possible to prevent generation of a crack on the endless belt with the bent portion as a starting point, so that longer life span of the endless belt can be implemented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A The belt driving device for use in an image forming apparatus, comprising:

a plurality of rollers placed in parallel with each other;

an endless belt wound with tension so as to encircle all of a plurality of rollers, the endless belt having a pair of side edge portions that should be positioned at respective outsides of a plurality of the rollers with respect to an axial direction of the rollers, with first and second elastic bodies provided on respective inner circumferences of a pair of the side edge portions along a circumferential direction of the belt; and first and second rotating members attached to respective opposite ends of at least one roller out of a plurality of the rollers, so as to face the first and second elastic bodies, respectively, and to be concentric with the one roller, wherein the first and second rotating members respectively have:

first and second tapered sections each having a tapered form with a width decreasing from inside toward outside with respect to the axial direction and coming into contact with the first and second elastic bodies provided on the endless belt, respectively, so as to regulate meandering of the endless belt; and first and second bottom receiving sections provided at respective outsides of the first and second tapered sections with respect to the axial direction and having a shape thicker than respective outer ends of the first and second tapered sections, so as to keep bending of the endless belt within a certain amount; and wherein the first and second bottom receiving sections have a cylindrical surface with a diameter larger than that of respective outer ends of the first and second tapered sections.

2. The belt driving device as claimed in claim 1, wherein the first rotating member includes: a first small diameter section to form a first escape groove between the first tapered section and the first bottom receiving section for receiving the first elastic body; and a third tapered section having a tapered form with a width increasing from inside toward outside with respect to the axial direction and provided between the first small diameter section and the first bottom receiving section, wherein the second rotating member includes: a second small diameter section to form a second escape groove between the second tapered section and the second bottom receiving section for receiving the second elastic body; and a fourth tapered section having a tapered form with a width increasing from inside toward outside with respect to the axial direction and provided between the second small diameter section and the second bottom receiving section.

3. The belt driving device as claimed in claim 2, wherein an outer radius R [mm] of the at least one roller, an outer radius r [mm] of the first and second bottom receiving sections, and a thickness c [mm] of the first and second elastic bodies satisfy an equation below:

$$r<(R-c)\leqq(r+0.7).$$

4. The belt driving device as claimed in Claim 1, wherein the endless belt is used for image transfer.

5. An image forming apparatus comprising the belt driving device as claimed in Claim 1.

* * * * *